United States Patent [19]

Hess

[11] 4,326,845

[45] Apr. 27, 1982

[54] SUSPENSION PREHEATER FOR CEMENT CALCINING PLANT

[75] Inventor: Paul D. Hess, Brookfield, Wis.

[73] Assignee: Allis-Chalmers Corporation, Milwaukee, Wis.

[21] Appl. No.: 222,035

[22] Filed: Jan. 2, 1981

[51] Int. Cl.[3] ..... F27B 7/02; F27B 15/00

[52] U.S. Cl. ..... 432/106; 432/58

[58] Field of Search ..... 432/58, 106

[56] References Cited

U.S. PATENT DOCUMENTS

| | | | |
|---|---|---|---|
| 3,049,343 | 8/1962 | Helming | 432/58 |
| 3,358,426 | 12/1967 | Husbjerg | 432/117 |
| 3,836,323 | 9/1974 | Engel | 432/106 |
| 3,891,383 | 6/1975 | Kobayashi | 432/80 |
| 3,904,353 | 9/1975 | Bosshard et al. | 432/14 |
| 3,914,098 | 10/1975 | Kano et al. | 432/106 |
| 4,039,277 | 8/1977 | Kobayashi et al. | 432/58 |
| 4,094,626 | 6/1978 | Boyhont et al. | 432/58 |
| 4,119,396 | 10/1978 | Abelitis et al. | 432/106 |

FOREIGN PATENT DOCUMENTS

| | | | |
|---|---|---|---|
| 1586476 | 2/1970 | France | 432/58 |

*Primary Examiner*—John J. Camby
*Attorney, Agent, or Firm*—Lee H. Kaiser

[57] ABSTRACT

A multi-stage cement calcining plant suspension preheater has a calcining combustor flow connected with a cyclone separator in the uppermost stage and helical duct inertial separators in the remaining stages which are lower in height and in pressure drop than conventional cyclone separators and permit reduction in height of the preheater tower and use of a lower horsepower fan to move kiln-off gases through the preheater.

19 Claims, 8 Drawing Figures

SUSPENSION PREHEATER FOR CEMENT CALCINING PLANT

BACKGROUND OF THE INVENTION

Plants for heat treating granular raw material such as cement raw meal often include one or more vertical multi-stage suspension preheater strings each of which includes a plurality of serially connected cyclone separators that receive cement raw material at the top and hot exhaust gases from the rotary kiln at the bottom with countercurrent flow of the hot gases and the cement raw meal through the preheater to thereby preheat the raw cement feed for the rotary kiln. A typical calcining cement suspension preheater string such as disclosed, for example, in U.S. Pat. Nos. 3,891,383; 3,904,353 and 3,914,098 may include four serially connected cyclone separators interconnected by heat exchanger conduits and meal pipes to achieve four stages of heat exchange. Each cyclone separator has an inlet for hot gas and suspended raw meal, an outlet at its upper end for separated hot gases connected to a stage above, and an outlet at its lower end for separated raw cement meal connected to a stage below. The cyclone separators in the suspension preheater string are spaced apart vertically, and the raw cement meal flows by gravity through meal pipes interconnecting the cyclone separators while kiln off gas is moved upwardly through the separators and heat exchange conduits by suction from an induced draft fan.

Cement plants of such multi-stage preheater strings are of extreme vertical height, for example, 190 feet height for a four stage cyclone-type suspension preheater, and the vertical dimension of each cyclone separator contributes significantly to the undesirable height of a conventional cyclone-type suspension preheater tower.

A conventional cyclone separator has a relatively high gas pressure drop and relatively high friction loss which result in high energy losses in the calcining cement suspension preheater and necessitate use of high horsepower induced draft fans. Power consumption in a cyclone type preheater results principally from moving the gas against the pressure differential of the cyclone separators. A major portion of the gas pressure drop in a cyclone separator results from: (a) the energy required to draw the relatively low whirl velocity gas at the cyclone body diameter into the higher whirl velocity of the gas exit pipe diameter, and (b) the unrecovered energy of the higher whirl velocity of the exit gas stream. Cyclone separator type suspension preheater strings are usually limited to four stages because of height and pressure drop limitations.

U.S. Pat. No. 3,049,343 to Helming discloses a cement plant preheater wherein the axes of the cyclone separators are inclined at a 45 degree angle to the horizontal for the purpose of reducing the height of the preheater tower, but such arrangement has not proven commercially successful and has the above discussed disadvantage of cyclone separators.

U.S. Pat. No. 3,358,426 to Husbjerg discloses apparatus for preheating cement raw meal and separating the hot meal particles from the gas after heat transfer which utilizes centrifugal force to throw the meal particles against the outer wall of a curved pipe and precipitate them from the gas, but the apparatus disclosed in this prior art patent has only a single stage of heat transfer and would be capable of carrying out only a relatively small percent of the calcination of the cement meal.

OBJECTS OF THE INVENTION

It is an object of the invention to provide an improved multi-stage suspension preheater for a cement calcining plant which is more compact and substantially reduced in height in comparison to a preheater using cyclone operators. Another object is to provide an improved multi-stage suspension preheater for a cement calcining plant which is more compact and substantially reduced in height in comparison to a preheater using cyclone separators. Another object is to provide such an improved multi-stage suspension preheater which permits a reduction of up to forty percent in the height of a suspension preheater tower in comparison to a conventional suspension preheater using cyclone separators. Still another object is to provide such an improved suspension preheater which has more stages than, but is approximately of the same height and pressure drop as, a conventional four stage preheater of the cyclone separator type to thereby increase preheating of the meal and reduce fuel requirements.

It is a further object of the invention to provide an improved multi-stage suspension preheater for a cement calcining plant which requires substantially less total system energy to operate than a conventional suspension preheater using cyclone separators and which also permits use of fans which develop substantially less power than fans used with conventional suspension preheaters of the cyclone separator type. Another object is to provide such an improved multi-stage suspension preheater which permits use of induced draft fans having a horsepower rating of approximately one half that of fans used with cyclone type suspension preheaters of the same capacity.

SUMMARY OF THE INVENTION

A multi-stage cement calcining plant suspension preheater having a calcining furnace and serially connected heat exchange and gas/meal separator stages for preheating raw cement meal before it is fed to the calcining furnace is characterized in accordance with the invention by helical duct inertial separators in a plurality of the preheater stages each of which comprises a hollow elongated continuous duct having its longitudinal axis disposed generally along a downwardly inclined helical path with its inlet end at a higher elevation than its outlet end and having a gas inlet opening in a vertical plane for receiving a horizontal stream of gas with cement meal suspended therein, means including a downwardly inclined upper wall and a concave outer side wall for deflecting the gas stream into a downwardly inclined helical path within said duct, a generally horizontal bottom wall in the path of the helically downward directed gas stream, a meal exit opening in the bottom wall and a gas exhaust opening in the top wall adjacent the outlet end of the duct, whereby the helically downward directed gas stream impinges on the bottom wall and is deflected upward and drawn by suction toward the gas exhaust opening while the heavier meal is precipitated from the gas stream and flows under centrifugal and inertial forces along the bottom wall into the meal exit opening. In comparison to conventional cyclone separators, the helical duct inertial separators are substantially reduced in height and have substantially lower pressure drop across the separator, thereby reducing the height of the suspension preheater and the horsepower capacity of the induced draft fan which draws the gas through the separators. A suspension preheater embodying the invention is further characterized in that the uppermost stage has a cyclone separator and that the calcining furnace has a combustion gas and calcining cement outlet connected to the gas inlet opening of a helical duct inertial separator of the lowermost stage and also has a preheated cement meal inlet connected by a feed pipe to the meal exit opening of a helical duct inertial separator of the stage immediately above the lowermost stage.

BRIEF DESCRIPTION OF THE DRAWINGS

The invention will be described in connection with the attached drawing wherein.

DETAILED DESCRIPTION OF THE DRAWINGS

Figure 1:
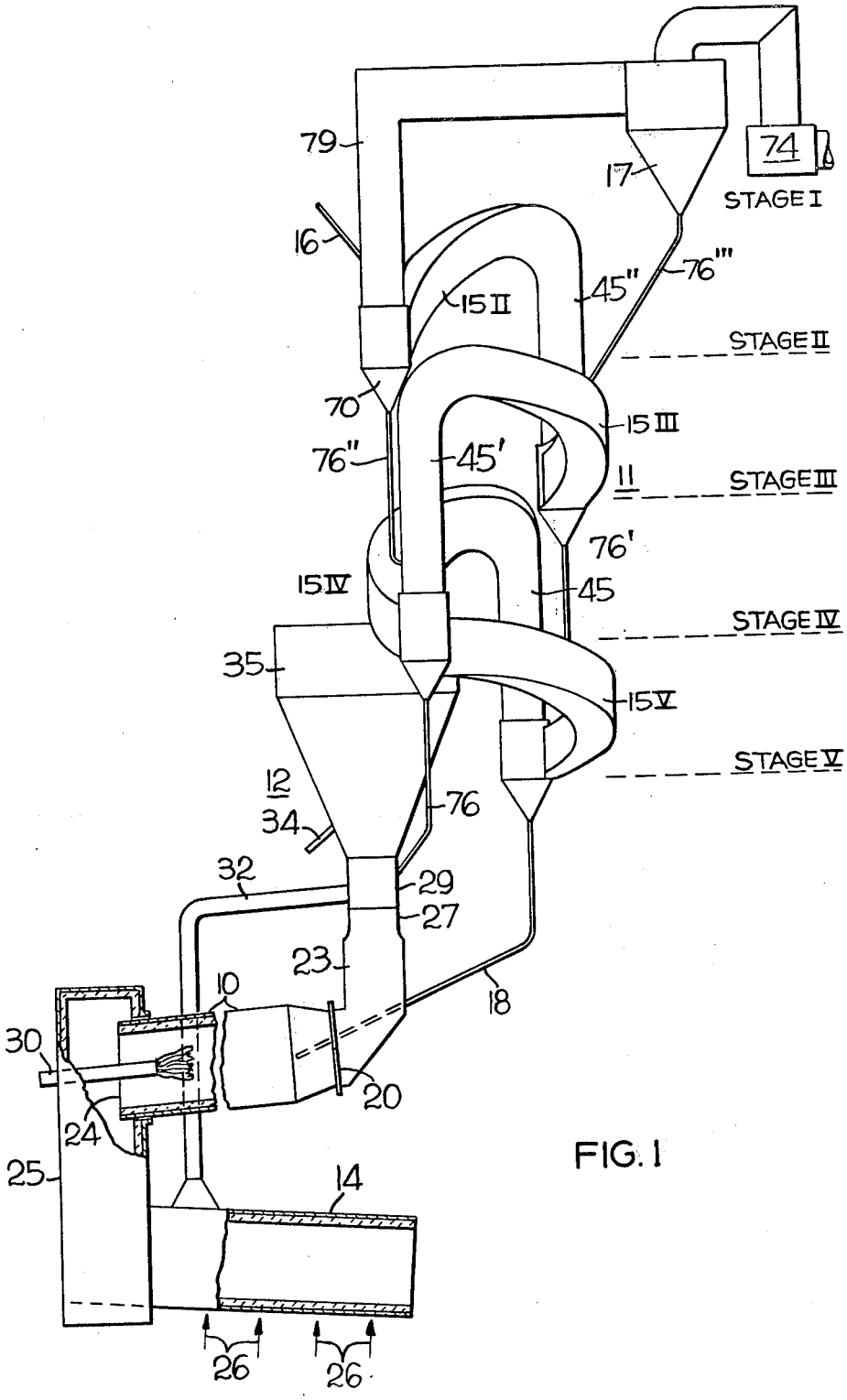
FIG. 1 is a schematic front view of a cement calcining plant having a multi-stage suspension preheater string embodying the invention.

FIG. 1 schematically illustrates a cement calcining plant including a rotary cement clinkering furnace, or kiln 10, a single multi-stage cement suspension preheater string 11 embodying the invention and including a calcining combustor, or calcining furnace 12 for substantially completely calcining the preheated raw cement meal before it is fed to kiln 10, and a clinker cooler 14 coupled after the kiln 10 for cooling the product treated in the kiln.

Suspension preheater 11 is shown as having connected in series an upper stage I having a cyclone separator 17, three serially flow-connected meal/gas separator stages II, III and IV each having an inertial helical duct separator 15 of the type disclosed in my copending application Ser. No. 222,034 entitled Helical Duct Inertial Separator filed Jan. 2, 1981 and designated 15II, 15III, and 15IV respectively, and a calcination stage V including calcining combustor 12 and such a helical duct inertial separator designated 15V. Suspension preheater 11 has an inlet pipe 16 for cement raw meal at the top thereof and an outlet meal pipe 18 connecting calcination stage V to the cement meal inlet end 20 of rotary kiln 10.

The cement meal inlet end 20 if kiln 10 may communicate with guide means such as a hood 23 having an opening in a vertical plane surrounding kiln inlet end 20. The clinker discharge end 24 of kiln 10 may communicate with a casing 25 which at its lower end joins cooler 14 which may be of the grate type. Cooler 14 receives the hot clinker discharged from kiln 10 through casing 25, and the hot clinker is cooled and the cooling air is heated. Hood 23 has a restricted furnace gas conduit 27 at its upper end which communicates with a mixing chamber 29 at the lower end of calcining combustor 12. Part of the hot air from cooler 14 leaving casing 25 is passed through kiln 10 where the oxygen therein nourishes combustion of fuel blown into kiln 10 through a burner pipe 30 provided at the clinker discharge end 24 of kiln 10. The hot exhaust gases pass through kiln 10 countercurrent to the preheated, substantially completely calcined cement meal which is fed from outlet meal pipe 18 of calcination stage V into meal inlet end 20 of kiln 10. The cement meal moves down through kiln 10 where it is chemically and physically changed under the influence of the heat in kiln 10. The hot exhaust gases leave kiln 10 through end 20 and enter hood 23 and then exit from hood 23 through restricted furnace gas exhaust throat conduit 27 which increases the velocity of exhaust gases flowing into mixing chamber 29. Hot air from clinker cooler 14 enters casing 25 and passes through an air duct 32 into mixing chamber 29. Preheated cement meal from inertial separator 15IV of stage IV is introduced into mixing chamber 29 through meal pipe 16, i.e., into the preheated cement inlet to the calcining combustor 12, and is entrained in the hot kiln-off gases rising through furnace gas exhaust conduit 27. A splash plate (not shown) is disposed within mixing chamber 29 opposite the lower end of meal pipe 76 to distribute the meal into the hot kiln-off gases, rising through conduit 27 which mix with air from cooler 14 introduced into mixing pipe 29 through duct 32. Fuel is also injected through burners 34 into the air/meal mixture within combustion chamber 35 of calcining furnace 12 where it burns to heat and calcine the raw cement material so suspended in the hot gas before the meal is introduced into kiln 10. Combustion within combustion chamber 35 is nourished by oxygen contained in the heated air from cooler 14 introduced through duct 32.

Figure 2:
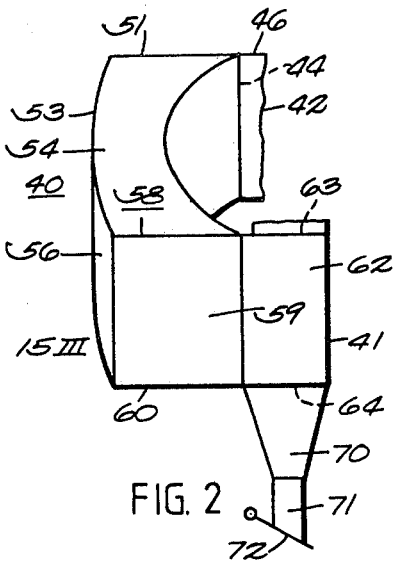
FIGS. 2, 3 and 4 are front, top and side views respectively of the helical duct inertial separators shown in FIG. 1.
Figure 3:
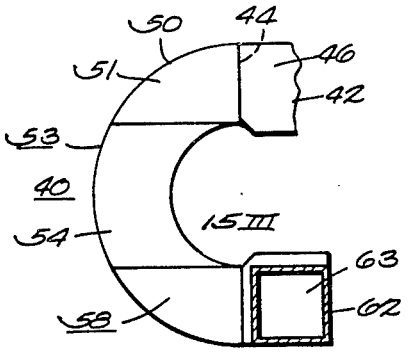
Figure 4:
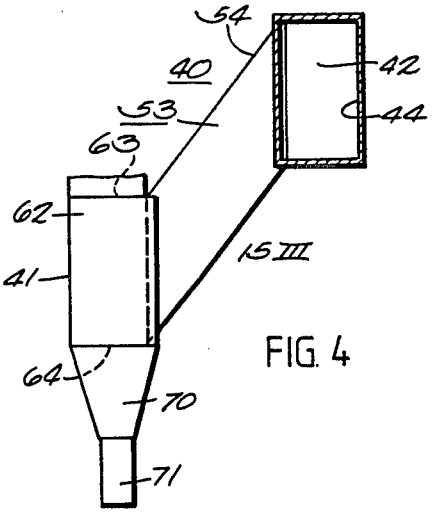

Gas/meal helical duct inertial separator 15III of stage III is shown in detail in FIGS. 2, 3 and 4 and includes a hollow elongated continuous duct 40 of rectangular transverse cross section having its longitudinal axis disposed generally along a generally spiral path, i.e., more specifically, along a portion of a turn of a helix whose axis is vertical. Elongated continuous duct 40 is preferably approximately U-shaped in longitudinal cross section with its outlet end 41 disposed at a vertically lower elevation than its inlet end 42. Duct 40 has a vertically facing inlet opening 44 adjacent inlet end 42 for receiving a generally horizontal current, or stream of hot gas with raw cement meal entrained, or suspended therein. The horizontal gas current flowing into inlet opening 44 comprises hot kiln-off gases from the stage below flowing upward through a heat exchange elbow conduit 45' of generally inverted-L configuration (See FIG. 5) and rectangular transverse cross section having the cross bar portion 46 thereof registering with inlet opening 44 and the downwardly inclined leg portion 48 registering with the gas exhaust opening of the helical duct separator 15IV of the stage below.

Inlet opening 44 is in a vertical plane and is partially defined by horizontal top and bottom walls and a curvate vertical side wall 50 of a first transition portion 51 of helical duct 40. Curvate vertical side wall 50 is in the path of the horizontal gas stream and directs the gas stream and suspended meal horizontally and at an acute angle from the inlet direction into a downwardly inclined generally arcuate-in-longitudinal-cross-section portion 53 of duct 40 which registers with first transition portion 51. Arcuate portion 53 is of rectangular transverse cross section and has a downwardly inclined upper wall 54 and a vertical, concave, outer side wall 56 both of which are in the path of the horizontal gas current from first transition portion 51 and together with side wall 50 comprise means to deflect the gas stream and suspended meal into a downwardly inclined helical path within duct 40 so that they are acted upon by radially outward directed centrifugal force and tangentially directed inertial force.

At its downstream end arcuate portion 53 of duct 40 registers with a second transition portion 58 having a horizontal top wall, a horizontal bottom wall 60 and a curvate vertical side wall 59. Bottom wall 60 and curvate side wall 59 of second transition portion 58 are in the path of the helically downward directed gas stream and suspended meal which are being acted upon by centrifugal and inertial forces. Curvate side wall 59 changes the direction of the gas stream and suspended meal particles into a path approximately the reverse of the direction of the horizontal current received by inlet opening 44, and horizontal bottom wall 60 deflects the gas stream upward and redirects the downwardly urged heavier meal particles horizontally so that they precipitate from the gas stream and flow under the centrifugal and inertial forces along bottom wall 60.

Second transition portion 58 communicates with a meal collection box 62 which in its upper wall has a gas exhaust opening 63 in a horizontal plane and in its lower wall has a meal exit opening 64 in a horizontal plane. Gas exhaust opening 63 registers with the upwardly extending leg portion 48 of the generally inverted-L shaped heat exchanger elbow conduit 45'' of stage II above. Meal exit opening 64 communicates with the open upper end of a meal hopper 70 which may be of generally inverted pyramidal configuration truncated at its apex, and at its lower end hopper 70 terminates in a vertical meal outlet pipe 71 that is closed by a meal valve 72 to prevent air or gas from entering meal outlet pipe 71 under vacuum operating conditions. As described hereinafter, meal outlet pipe 71 communicates with a meal pipe 76' (see FIG. 1) which feeds separated meal to the heat exchange elbow conduit 45 of stage IV below. The gas stream is deflected upwardly by horizontal bottom wall 60 of second transition portion 58 and drawn by suction from conduit 45'' toward gas exhaust opening 63 while the heavier meal particles precipitate from the gas stream and flow under the centrifugal and inertial forces along horizontal bottom wall 60 and through meal exit opening 64 into hopper 70.

Helical duct 40 is thus defined by first transition portion 51, arcuate portion 53, second transition portion 58 and meal collection box 62 and preferably is of arcuate longitudinal cross section and preferably extends through approximately 180 degrees of arc, and inlet opening opening 44 and gas exhaust opening 63 are at approximately the same radial distance from the center of such arc. This configuration results in substantial reduction in pressure drop across inertial helical duct separator 40 in comparison to a conventional cyclone separator wherein a major portion of the gas pressure loss results from the energy required to draw the relatively low whirl velocity gas at the cyclone body outer diameter into the higher whirl velocity of the axial exit gas stream. It will be appreciated that such losses are substantially eliminated in helical duct inertial separator 40.

Figure 6:
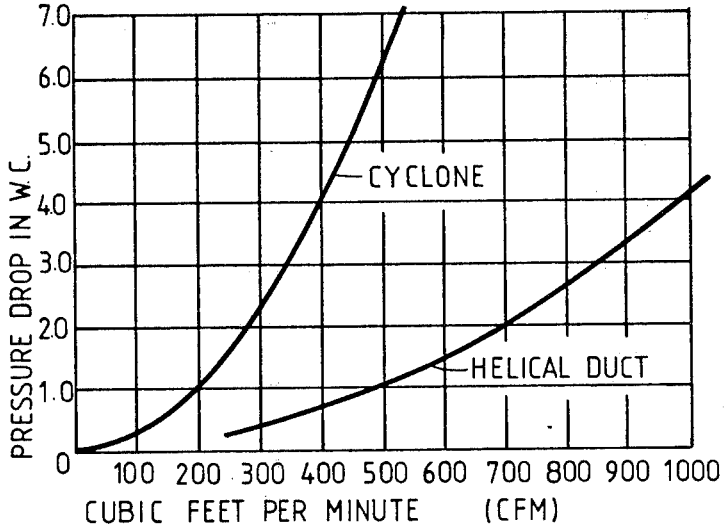
FIG. 6 is a graph plotting pressure drop versus volume of raw cement meal flow per unit time in a conventional cyclone separator and in a helical duct inertial separator of the type illustrated in FIGS. 2–4.
Figure 8:
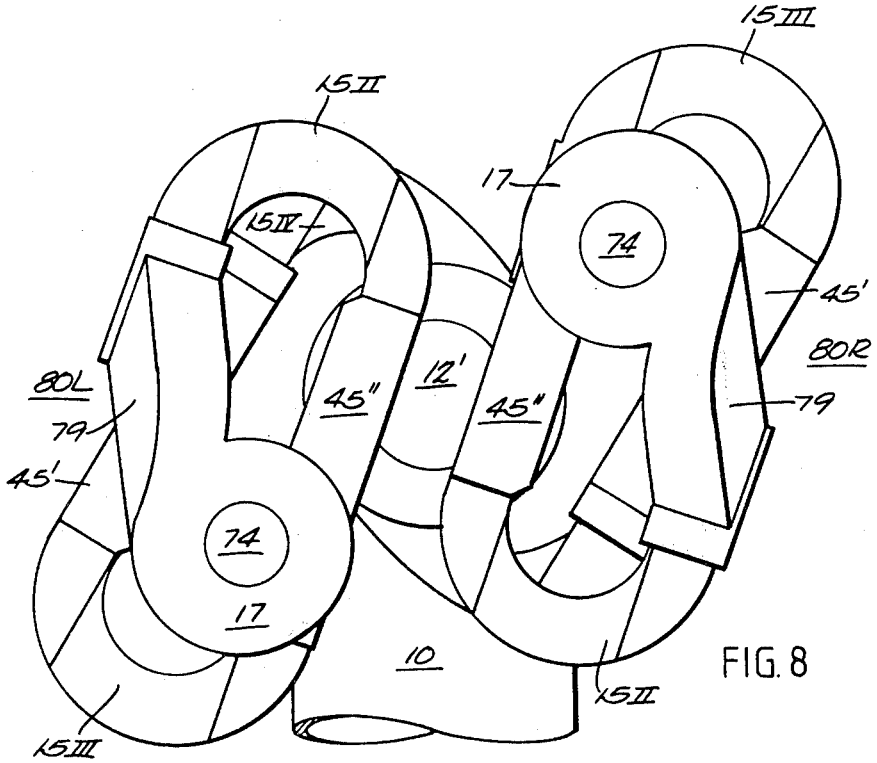
FIGS. 7 and 8 are front and top views respectively of a cement calcining plant dual multi-stage suspension preheater embodiment of the invention having four stages.

FIG. 6 plots the pressure drop (in inches of water) versus volume of ambient air flow per unit of time (in cubic feet per minute) through: (a) a conventional cyclone separator; and (b) a helical duct separator 15, and it will be noted that the pressure drop through helical duct separator 15 is only a minor fraction of the pressure loss in a cyclone separator for a given volume of gas flow per unit time. For example, FIG. 8 shows that the pressure drop in drawing 500 cubic feet per minute of ambient air through helical duct separator 15 is approximately 1.05 inches of water, whereas the pressure drop in moving the same volume through a conventional cyclone separator is approximately 6.1 inches of water. It will be appreciated that such difference in pressure loss greatly reduces the static pressure and power that a fan, such as induced draft fan 74 represented in FIG. 1, must develop to move the kiln-off gases through the multiple stages of the preheater string in comparison to a preheater of the cyclone separator type since power consumption in a preheater results principally from moving the gas against the differential pressure of the separator.

Figure 5:
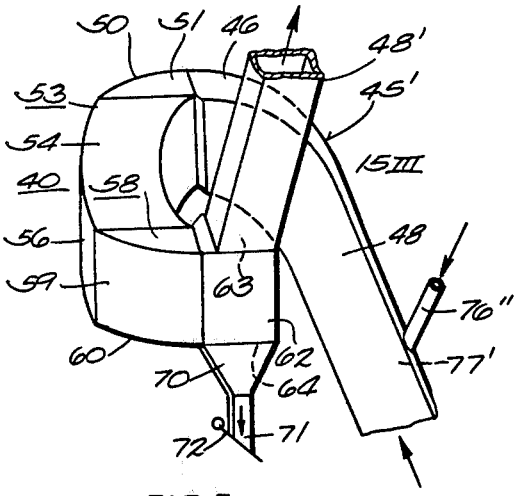
FIG. 5 is a front view of a single stage heat exchanger and meal/gas separator of the type used in the FIG. 1 embodiment.

FIG. 5 illustrates a single heat exchanger and helical duct meal/gas separator stage of a suspension preheater embodying the invention, for example, stage III which include helical duct separator 15III, heat exchanger elbow conduit 45' which registers at its upper end with gas inlet opening 44 of separator 15III and at its lower end with gas exhaust opening 63 of separator 15IV of stage IV; separated meal pipe 76'' whose upper end communicates with meal outlet pipe 71 from hopper 70 of stage II and at its lower end communicates with the interior of the leg portion 48 of heat exchanger elbow conduit 45'; and a splash plate 77 positioned within conduit 45' opposite the lower end of meal pipe 76' which distributes the meal from pipe 76 into the hot separated gases from stage IV rising through elbow conduit 45'. The cement meal separated in stage II and descending through pipe 76'' is moved upward through substantially the entire length of elbow conduit 45' by the rising hot gases from gas exhaust opening 63 of stage IV to achieve maximum heat transfer and further preheat the meal before it is separated from the gases in separator 15III and then fed through meal pipe 76' into elbow conduit 45 of stage IV.

FIG. 1 schematically represents that suspension preheater string 11 includes upper stage I having cyclone separator 17 which removes the extra fine particles in the raw cement meal fed into meal inlet pipe 16; an induced draft fan 74 connected to the gas exhaust outlet of cyclone separator 17 drawing the kiln-off gases with cement meal entrained therein through the five stages of preheater 11; a heat exchanger elbow conduit 79 which registers at its upper end with the gas inlet to a cyclone separator 17 and at its lower end with gas exhaust opening 63 of separator 15II of stage II; meal inlet pipe 16 which registers with the interior of heat exchanger elbow conduit 79 and through which raw cement meal is fed to preheater 11 and carried upward through conduit 79 with the rising hot separated gases from helical duct separator 15II to preheat the cement meal; a meal pipe 76''' which registers at its upper end with the separated meal outlet from cyclone separator 17 and at its lower end with the interior of heat exchanger elbow conduit 45'' of stage II so that the meal separated in cyclone separator 17 is further preheated by the gases separated in stage III rising within heat exchanger conduit 45''; meal pipe 76'' which at its upper end registers with separated meal hopper 70 of helical duct separator 15II of stage II and at its lower end with the interior of heat exchanger elbow conduit 45' so that the meal separated in stage IV rising through conduit 45'; meal pipe 76 which at its upper end communicates with separated meal hopper 70 of helical duct separator 15III and at its lower end communicates with heat exchanger elbow conduit 45 to further preheat the separated meal from stage III by the gases separated from helical duct separator stage V rising within conduit 45; meal pipe 76 which at its upper end communicates with meal hopper 70 of helical duct separator 15IV of fourth stage IV and at its lower end with the preheated meal inlet into mixing chamber 29 of calcining combustor 12; preheater stage V having a helical duct separator 15V whose gas inlet opening 44 registers with a combustion gas and calcined meal outlet (not shown) from the upper portion of calcining combustor 12 so that stage V receives substantially completely calcined cement meal as an input and whose separated meal hopper 70 is connected by meal pipe conduit 18 to the meal inlet end 20 of kiln 10.

Figure 7:
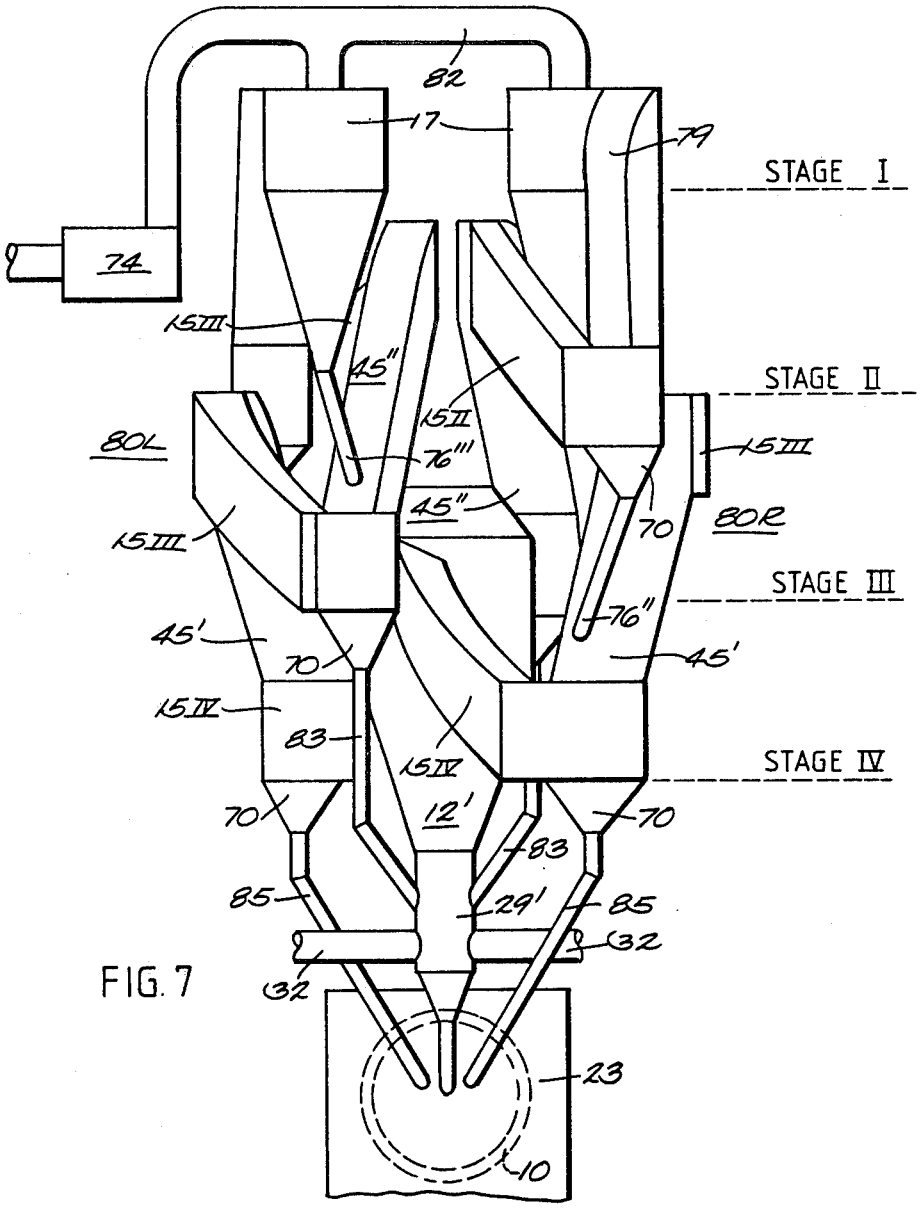

FIGS. 7 and 8 are front and top views respectively of a cement calcining plant dual preheater embodiment of the invention employing helical duct inertial separators 15 and having two suspension preheater strings 80L and 80R both of which are analogous to preheater string 11 of FIG. 1 embodiment with the exception that each string 80L or 80R comprises one cyclone type stage and only three helical duct separator stages. In effect, each preheater string 80L and 80R eliminates stage IV of the FIG. 1 embodiment. Both preheater strings 80L and 80R have an upper stage I provided with cyclone separator 17 whose gas inlet receives hot gases from an elbow conduit 79 which at its lower end communicates with the gas exhaust opening of helical duct inertial separator 15II of stage II. The gas exhaust openings of the cyclone separators 17 of both strings communicate with a duct 82 connected to a single induced draft fan 74 that draws the kiln off gases upwardly through the meal/gas separators and heat exchanger conduits of both strings by suction. The meal outlet from cyclone separator 17 of stage I registers with a meal pipe 76'' which at its lower end communicates with the interior of an elbow conduit 45''. At its upper end elbow conduit 45'' registers with the gas inlet opening of helical duct separator 15II, and at its lower end conduit 45'' registers with the gas exhaust opening of helical duct separator 15III of stage III. Meal hopper 70 of stage II registers with meal pipe 76'' that communicates with the interior of elbow conduit 45' which at its upper end registers with the gas inlet opening of helical duct separator 15III of stage III and at its lower end communicates with the gas exhaust opening of helical duct separator 15IV of stage IV. Meal outlet pipe 83 from hopper 70 of separator 15III of strings 80L and 80R differs from the FIG. 1 embodiment in that at its lower end it communicates with the preheated meal inlet to mixing chamber 29' of a single calcining combustor 12' for both preheater strings 80L and 80R.

The fourth stage also differs from the FIG. 1 embodiment in that the gas inlet opening of helical duct separator 15IV of both strings 80L and 80R communicates with the combustion gas and calcined meal outlet of calcining combuster 12' adjacent the top thereof and also in that the meal hopper 70 of helical duct separator 15IV communicates with the upper end of a meal pipe 85 which at its lower end communicates with the meal inlet end of kiln 10. Two air inlet ducts 32 from the cooler (not shown in FIGS. 7 and 8) communicate with mixing chamber 29' of calciner 12'.

The height of each helical duct separator 15 is approximately 49 percent of the height of a typical cyclone separator. Inasmuch as preheater 11 of FIG. 1 embodiment includes one cyclone separator stage I, the overall stacking height of the five stages of preheater 11 of this embodiment will be approximately sixty percent of the height of the typical cyclone separator preheater tower. The height of a typical four stage dual preheater of the cyclone separator type with a single combustion chamber rated at 3000 standard tons per day capacity is approximately 190 feet from the top to the longitudinal axis of the kiln, whereas the height of the four dual preheater embodiment of the invention illustrated in FIGS. 7 and 8 using helical duct separators 15 in three stages thereof is only approximately 110 feet. Further, the pressure requirement of the induced draft fan for the dual preheater embodiment of the invention employing helical duct inertial separators illustrated in FIGS. 7 and 8 is less than one-half that of a conventional four stage preheater with cyclone separators.

Tests establish that collection efficiency of helical duct separators 15 for finely ground meal is in the range from 84 to 88 percent and is only slightly less that that of a standard cyclone separator. Helical duct separators 15 permit construction of a suspension preheater having more stages than a conventional four-stage cyclone separator type preheater without increase in height or pressure drop, thereby increasing preheating of the meal and reducing the fuel requirements.

The embodiments of the invention in which an exclusive property or privilege is claimed are defined as follows:

1. A multi-stage cement calcining plant suspension preheater having a plurality of stages each of which has a separator for separating raw cement meal from gas in which the meal is suspended and wherein said separators of said plurality of stages are serially connected and in series with a calcining combustor, characterized in that the separators in certain of said stages are helical duct inertial separators each of which comprises a hollow elongated continuous duct having its longitudinal axis disposed generally along a downwardly inclined helical path with its inlet end at a higher elevation than its outlet end, said duct having adjacent said inlet end a gas inlet opening in a vertical plane for receiving a generally horizontal gas stream with cement meal suspended therein, means including a downwardly inclined upper wall and a concave outer side wall for deflecting said horizontal stream into a downwardly inclined helical path within said duct, a generally horizontal bottom wall in the path of the helically downward directed gas stream, a meal exit opening in said bottom wall adjacent said outlet end, and a gas exhaust opening in the top wall adjacent said outlet end, whereby said helically downward directed gas stream impinges upon said bottom wall and is deflected upward toward said gas exhaust opening while the heavier meal is urged by centrifugal and inertial forces to precipitate from said gas stream and flow along said bottom wall toward said meal exit opening.

2. A suspension preheater in accordance with claim 1 wherein the separator of the uppermost stage is a cyclone separator and each of the remaining stages includes one of said helical duct inertial separators.

3. A suspension preheater in accordance with claims 1 or 2 further characterized in that said calcining combustor has a combustion gas and calcined cement outlet connected to said gas inlet opening of the helical duct separator of the lowermost stage and also has a preheated cement meal inlet connected by a meal feed pipe to said meal exit opening of the helical duct separator of the stage immediately above said lowermost stage.

4. A suspension preheater in accordance with claim 3 further characterized in that each of said plurality of stages except said lowermost stage includes a heat exchanger elbow conduit of generally inverted-L configuration which communicates at its upper end with the gas inlet opening of said separator and is contoured to direct the gas rising therein into a horizontal stream and which also communicates at its lower end with the gas exhaust opening of the separator of the stage below it and also includes a meal exit pipe which communicates at its upper end with the meal exit opening of the separator of the stage above it and communicates at its lower end with said heat exchanger conduit, and wherein said heat exchanger conduit of said uppermost stage has a meal feed inlet for introducing raw cement meal into said preheater.

5. A suspension preheater in accordance with claim 4 further characterized in that said outer concave wall of each of said helical duct separators extends generally along an arc and in that said gas inlet opening and said gas exhaust opening of each said helical duct separator are at approximately the same radial distance from the center of said arc, whereby the pressure drop across each said separator is minimized.

6. A suspension preheater in accordance with claim 3 characterized in having two strings of said plurality of separator stages and that said calcining combustor has two diametrically opposed combustion gas and calcined cement outlets each of which communicates with the gas inlet opening of the helical duct separator of the lowermost stage of one of said strings and also has two diametrically opposed preheated meal inlets each of which communicates with the meal exit opening of the separator of the stage above the lowermost stage in one of said strings.

7. A multi-stage cement calcining plant suspension preheater string characterized by a plurality of stages at different elevations each of which has a helical duct inertial separator for separating raw cement meal from gas in which said meal is suspended, each said separator including a hollow elongated continuous duct having its longitudinal axis disposed generally along the path of a helix whose axis is vertical with its inlet end at a higher elevation than its outlet end and having an inlet opening at said inlet end for receiving a horizontal stream of said gas having said meal suspended therein and means including a downwardly inclined upper wall and a concave outer side wall for deflecting said horizontal stream into a downwardly inclined helical path within said duct, a gas exhaust opening in its upper wall adjacent said outlet end, a generally horizontal bottom wall in the path of said helically downward directed gas stream, and a meal exit opening in said bottom wall adjacent said outlet end, whereby said helically downward directed gas stream impinges upon and is deflected upward by said bottom wall toward said gas exhaust opening while the heavier meal is urged by centrifugal and inertial forces to precipitate from said gas and flow along said bottom wall toward said meal exit opening, each said stage also including a heat exchange conduit which communicates at its upper end with said inlet opening of said elongated duct and is contoured to direct gas flowing therethrough into a horizontal stream and communicates at its lower end with the gas exhaust opening of the helical duct separator of said stage below it and an upwardly extending meal feed pipe which communicates at its upper end with said meal exit opening of the separator of the stages above it and at its lower end with said heat exchanger conduit, whereby said helical duct separators in said plurality of stage are serially connected and the height of said preheater string is minimized.

8. A suspension preheater string in accordance with claim 7 further characterized in that said elongated duct of each said separator extends generally along an arc, and said inlet opening and said gas exhaust opening are at approximately the same radial distance from the center of said arc, whereby the gas pressure drop across said separator is minimized.

9. A suspension preheater string in accordance with claim 7 further characterized in that said heat exchanger conduit is an elbow of generally inverted-L configuration with a cross-bar portion that communicates with said inlet opening of said elongated duct and an upwardly inclined leg portion that communicates with both the gas exhaust opening of the separator of the stage below it and also with said meal feed pipe.

10. A suspension preheater string in accordance with claim 7 further characterized in that each said separator includes a hollow meal hopper of generally truncated pyramidal shape with an upwardly facing inlet opening which communicates with said meal exit opening and a downwardly facing outlet opening adjacent its apex which communicates with said meal feed pipe of the stage below it.

11. A suspension preheater string in accordance with claim 9 further characterized as including an uppermost stage having a cyclone separator, a heat exchanger elbow conduit having a meal feed inlet for introducing raw cement meal to said preheater string and communicating at its upper end with the inlet opening to said cyclone separator and at its lower end with the gas exhaust opening of the helical duct separator of the stage below it, and a meal pipe communicating at its upper end with the meal exit opening of said cyclone separator and at its lower end with the heat exchange elbow conduit of the helical duct inertial separator of the stage below it.

12. A suspension preheater string in accordance with claim 10 further characterized in also including a cement calcining furnace having a combustion gas and calcined cement outlet communicating with said inlet opening of said helical duct separator of the lowermost stage and a preheated cement meal inlet communicating with said cement meal pipe of the stage immediately above said lowermost stage.

13. A multi-stage cement calcining plant suspension preheater having a plurality of separator stages each of which has a separator for separating raw cement meal from gas in which said meal is suspended, each said separator having an inlet opening for receiving a generally horizontal stream of said gas, exhaust gas and meal exit openings adjacent the top and bottom thereof respectively, and a downwardly inclined meal pipe communicating with said meal exit opening, said preheater also having a calcining combustor provided with a preheated cement meal inlet adjacent its lower end and a combustion gas and calcined meal outlet adjacent its upper end, said separators in said plurality of stages being connected in series and in series with said calcining combustor, characterized in that the uppermost of said plurality of stages has a cyclone separator and each of the remaining stages has a helical duct inertial separator including a hollow elongated continuous duct having its longitudinal axis disposed generally along a downwardly inclined path with its outlet end disposed at a lower elevation than its inlet end and having said inlet opening in a vertical plane adjacent said inlet end for receiving a generally horizontal stream of said gas with said meal suspended therein, means including a downwardly inclined upper wall and a concave outer side wall for deflecting said horizontal stream into a downwardly inclined helical path within said duct, and a generally horizontal bottom wall in the path of said helically downward directed gas stream, said meal exit opening being in said bottom wall adjacent said outlet end and said gas exhaust opening being in the top wall of said duct adjacent said outlet end, whereby said helically downward directed gas stream impinges upon and is deflected upward by said bottom wall toward said gas exhaust opening while the heavier meal is precipitated from the gas stream and flows under inertial and centrifugal forces along said bottom wall toward said meal exit opening, said inlet opening of said helical duct separator of the lowermost stage communicating with said combustion gas and calcined meal outlet of said calcining combustor and said meal pipe of the stage immediately above said lowermost stage communicating with said preheated meal inlet of said calcining combustor.

14. A suspension preheater in accordance with claim 13 further characterized in that each said stage except said lowermost stage includes a heat exchanger elbow conduit which communicates at its upper end with said inlet opening and is contoured to direct gas flowing therethrough into said generally horizontal stream received by said inlet opening and communicates adjacent its lower end with said gas exhaust opening of the stage below and with said meal exit pipe of the stage above it, and also in that said heat exchanger conduit of said uppermost stage has a meal inlet for feeding raw cement meal to said suspension preheater.

15. A suspension preheater in accordance with claim 14 further characterized in that said outer concave side wall in each said helical duct inertial separator extends generally along an arc, and said inlet opening and gas exhaust opening are at approximately the same radial distance from the center of said arc, whereby the gas pressure drop across each said helical duct separator is minimized.

16. A suspension preheater in accordance with claim 13, 14 or 15 characterized in having two strings of said plurality of separator stages and that said calcining combustor has two said combustion gas and calcined meal outlets each of which communicates with the inlet opening of the helical duct separator of the lowermost stage of one of said strings and also has two preheated meal inlets each of which communicates with the meal pipe of the stage above the lowermost stage in one of said strings.

17. A multi-stage cement calcining plant suspension preheater having flow connected separators at successively different elevations for separating cement meal from gas in which the meal is suspended characterized in that the separators in a plurality of said stages are helical duct inertial separators each of which comprises an elongated helical duct having its longitudinal axis disposed along a path which generally follows a fractional turn of a vertical axis helix and has an inlet adjacent one end in a vertical plane for receiving a horizontal stream of gas with meal suspended therein, upper and outer side wall means for deflecting said horizontal stream into a generally downwardly inclined helical path within said duct, and gas exhaust and meal exit openings respectively in the upper and lower surfaces of each duct adjacent its outlet end; and fan means for sucking said gas upwardly through said gas exhaust openings and through said flow connected helical duct separators in series while said meal is precipitated from said gas and flows under centrifugal and inertial forces downwardly through said meal exit openings.

18. A suspension preheater in accordance with claim 17 wherein the separator of the uppermost stage is a cyclone separator and each of the remaining stages includes one of said helical duct separators.

19. A suspension preheater in accordance with claim 17 or 18 wherein said separators of said plurality of stages are connected in series with a calcining combustor having a combustion gas and calcined cement outlet which communicates with said inlet of the helical duct separator of the lowermost stage.

* * * * *